US006612715B1

(12) United States Patent
Shiau

(10) Patent No.: US 6,612,715 B1
(45) Date of Patent: Sep. 2, 2003

(54) FLASHLIGHT WITH A CONNECTING DEVICE FOR CONNECTING LAMP TERMINALS OF A LAMP UNIT TO A BARREL AND A BATTERY UNIT

(76) Inventor: Wen-Chin Shiau, No. 10, Alley 1, Lane 551, Sec. 1, Wan-Shou Rd., Kuei-Shan Hsiang, Tao-Yuan Hsien (TW)

( * ) Notice: Subject to any disclaimer, the term of this patent is extended or adjusted under 35 U.S.C. 154(b) by 0 days.

(21) Appl. No.: 10/170,388

(22) Filed: Jun. 14, 2002

(51) Int. Cl.[7] ..... F21L 4/04
(52) U.S. Cl. ..... 362/204; 362/206; 200/60
(58) Field of Search ..... 362/206, 204; 200/60

(56) References Cited

U.S. PATENT DOCUMENTS 5,629,105 A * 5/1997 Matthews ..... 429/97
5,752,764 A * 5/1998 Shiau ..... 362/206
6,222,138 B1 * 4/2001 Matthews et al. ..... 200/4
6,296,371 B1 * 10/2001 Shiau ..... 362/206
6,386,732 B1 * 5/2002 Shiau ..... 362/202
6,474,834 B2 * 11/2002 Lai ..... 362/206
6,513,947 B1 * 2/2003 Huang ..... 362/206

* cited by examiner

*Primary Examiner*—Sandra O'Shea
*Assistant Examiner*—Jacob Y. Choi
(74) *Attorney, Agent, or Firm*—Foley & Lardner

(57) ABSTRACT

A flashlight includes a conductive barrel, a lamp unit and a tail cap switch. The tail cap switch includes a tail cap member, a push button member movable relative to the tail cap member, a conductive biasing member, and a contact blocking member to control the moving range of the push button member. In practice, the tail cap member is adjustable relative to the barrel to one of a normally closed position, a normally open position, and a switch on/off position between the normally closed position and the normally open position.

4 Claims, 5 Drawing Sheets

FLASHLIGHT WITH A CONNECTING DEVICE FOR CONNECTING LAMP TERMINALS OF A LAMP UNIT TO A BARREL AND A BATTERY UNIT

BACKGROUND OF THE INVENTION

1. Field of the Invention

The invention relates to a flashlight, more particularly to a flashlight with a tail cap switch.

2. Description of the Related Art

Referring to FIG. 1, a conventional flashlight 1 is shown to comprise a conductive barrel 11, a tail cap switch 12, a lamp unit 13 and a battery unit 14. The barrel 11 has a front end portion 111 and an externally threaded rear end portion 112 with a distal rear end face 113. The battery unit 14 has a first electrode and a second electrode opposite to the first electrode in a longitudinal direction. The lamp unit 14 includes a lamp having a first lamp terminal 132 connected electrically to the barrel 11, and a second lamp terminal 131 connected electrically to the first electrode of the battery unit 14.

The tail cap switch 12 is mounted threadedly on the rear end portion 111 of the barrel 11, and includes a tail cap member 121, a push button member 122 and a conductive biasing member 123. The tail cap member 121 has an end wall 1211 formed with a button hole 1210, and a tubular wall 1212 extending from a periphery of the end wall 1211 in the longitudinal direction.

The push button member 12 has an operating portion 1221 slidably extending through the buttonhole 1210, a conductive contact portion 1224 connected to the operating portion 1221 and disposed to confront the distal rear end face 113 of the barrel 11 in the longitudinal direction, and a tubular support 1222 extending from the conductive contact portion 1224 and slidably into the rear end portion 112 of the barrel 11.

The conductive biasing member 123 has a first biasing end for contacting electrically the second electrode of the battery unit 14, and a second biasing end disposed in the tubular support 1222 and electrically connected to the conductive contact portion 1224.

When the push button member 122 is not pressed and the tail cap member 121 is not thoroughly screwed on the barrel 11, the conductive biasing member 123 will bias the push button member 122 such that the conductive contact portion 1224 is spaced apart from the distal rear end face 113 of the barrel 11, thereby breaking electrical connection between the barrel 11 and the second electrode of the battery unit 14. On the other hand, when the push button member 122 is pressed or the tail cap member 121 is thoroughly screwed on the barrel 11 to the extent that the conductive contact portion 1224 abuts against the distal rear end face 113 of the barrel 11, electrical connection will be made between the barrel 11 and the second electrode of the battery unit 14.

The following are some of the drawbacks of the conventional flashlight 1:

1. When the tail cap switch 12 is removed, such as during replacement of the battery unit 14, the push button member 122 and the conductive biasing member 123 may fall out since there is no mechanism for preventing undesired removal of the same, thus resulting in inconvenience or even loss of components.

2. Accidental or unintentional pressing of the push button member 122 of the tail cap switch 12 will result in waste of battery power.

SUMMARY OF THE INVENTION

Therefore, the main object of the present invention is to provide a flashlight that can overcome the aforesaid drawbacks of the conventional flashlight.

Accordingly, a flashlight of this invention comprises:

a conductive barrel adapted to receive a battery unit therein, the barrel extending in a longitudinal direction and having a front end portion and an externally threaded rear end portion with a distal rear end face, the battery unit having a first electrode and a second electrode opposite to the first electrode in the longitudinal direction;

a lamp unit mounted in the front end portion, the lamp unit including a lamp having a first lamp terminal connected electrically to the barrel and a second lamp terminal adapted to be connected electrically to the first electrode; and a tail cap switch mounted on the rear end portion of the barrel, the tail cap switch including a tail cap member having an end wall and a tubular wall extending from a periphery of the end wall in the longitudinal direction, the end wall being formed with a button hole, the tubular wall having an inner wall surface formed with an internally threaded segment that is spaced apart from the end wall in the longitudinal direction and that cooperates with the end wall to form a contact receiving space, the internally threaded segment threadedly engaging the rear end portion of the barrel and forming an annular shoulder at a boundary with the contact receiving space, a push button member having an operating portion slidably extending through the button hole, a conductive contact portion connected to the operating portion and extending into the contact receiving space, the conductive contact portion being disposed to confront the distal rear end face of the barrel in the longitudinal direction, and a tubular support extending from the conductive contact portion and slidably into the rear end portion of the barrel, an insulator unit for preventing electrical connection between the conductive contact portion and the barrel via the tail cap member, a conductive biasing member having a first biasing end adapted to contact electrically the second electrode of the battery unit, and a second biasing end disposed in the tubular support and electrically connected to the conductive contact portion, and an annular contact blocking member made of an insulator material, disposed around the rear end portion of the barrel and within the contact receiving space, and abutting against the annular shoulder.

The tail cap member is adjustable relative to the barrel to one of a normally closed position, a normally open position, and a switch on/off position between the normally closed position and the normally open position.

When the tail cap member is at the normally closed position, the contact blocking member does not project rearwardly relative to the distal rear end face of the barrel, and the end wall of the tail cap member presses the conductive contact portion of the push button member to abut against the distal rear end face of the barrel and thus form a closed electrical circuit.

When the tail cap member is at the switch on/off position, the contact blocking member does not project rearwardly relative to the distal rear end face of the barrel, and the biasing member biases the push button member such that the conductive contact portion abuts against the end wall of the tail cap member and is spaced apart from the distal rear end face of the barrel to break electrical connection between the conductive contact portion and the barrel in a non-operated state of the push button member. The push button member is movable in the longitudinal direction against biasing action of the biasing member to abut the conductive contact portion against the distal rear end face of the barrel and make electrical connection therebetween when an external pressing force is applied on the operating portion.

When the tail cap member is at the normally open position, the contact blocking member is disposed to project rearwardly relative to the distal rear end face of the barrel so as to prevent the conductive contact portion of the push button member from abutting against the distal rear end face of the barrel.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
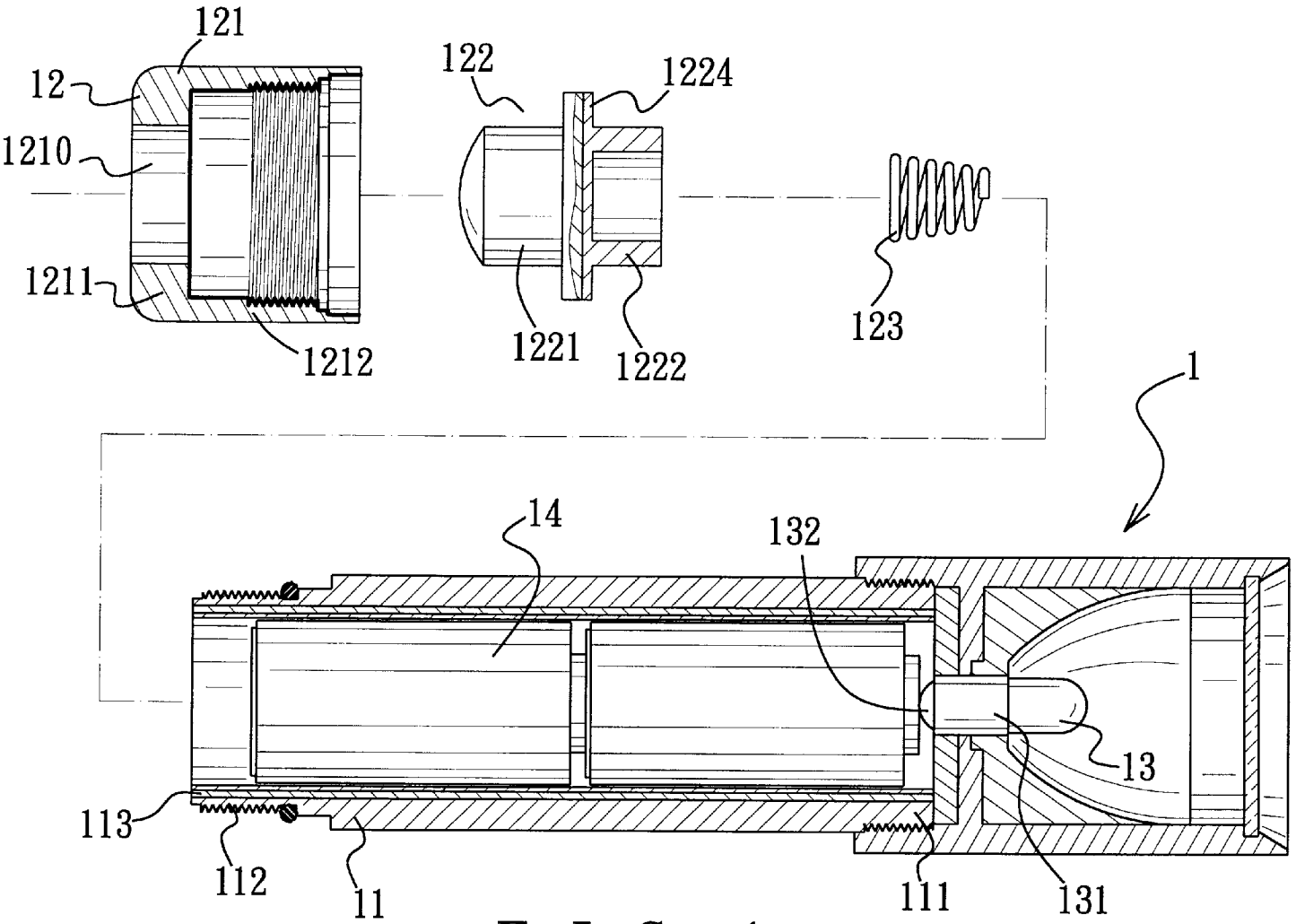
FIG. 1 PRIOR ART
FIG. 1 is a partly exploded sectional view illustrating a conventional flashlight.
Figure 2:
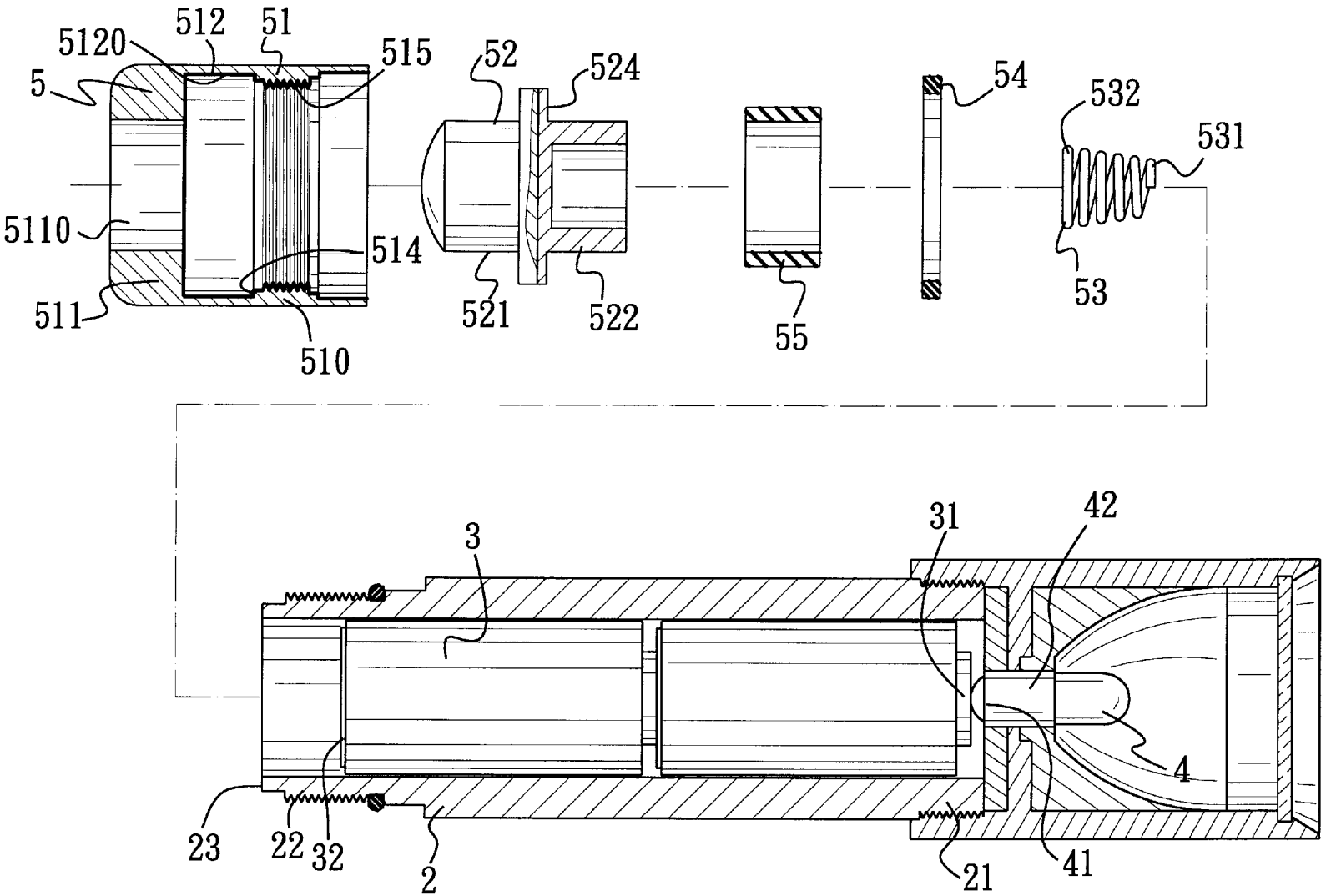
FIG. 2 is a partly exploded sectional view showing a first preferred embodiment of a flashlight according to the present invention.

Referring to FIG. 2, the first preferred embodiment of a flashlight according to the present invention is shown to include a conductive barrel 2, a lamp unit 4 and a tail cap switch 5.

The conductive barrel 2 is made of metal and is adapted to receive a battery unit 3 therein. The barrel 2 extends in a longitudinal direction, and has a front end portion 21 and an externally threaded rear end portion 22 with a distal rear end face 23. The battery unit 3 has a first electrode 31 and a second electrode 32 opposite to the first electrode 31 in the longitudinal direction.

The lamp unit 4 is conventional in construction, is mounted in the front end portion 21, and includes a lamp having a first lamp terminal 42 connected electrically to the barrel 2, and a second lamp terminal 41 adapted to be connected electrically to the first electrode 31 of the battery unit 3.

The tail cap switch 5 is mounted on the rear end portion 22 of the barrel 2, and includes a tail cap member 51, a push button member 52, a conductive biasing member 53, and a contact blocking member 54.

The tail cap member 51 has an end wall 511 and a tubular wall 510 extending from a periphery of the end wall 511 in the longitudinal direction. The end wall 511 is formed with a button hole 5110. The tubular wall 510 has an inner wall surface formed with an internally threaded segment 515 that is spaced apart from the end wall 511 in the longitudinal direction and that cooperates with the end wall 511 to form a contact receiving space 512. The internally threaded segment 515 threadedly engages the rear end portion 22 of the barrel 2 and forms an annular shoulder 514 at a boundary with the contact receiving space 512.

The push button member 52 has an operating portion 521 slidably extending through the button hole 5110, and a conductive contact portion 524 connected to the operating portion 521 and extending into the contact receiving space 512. The conductive contact portion 524 is disposed to confront the distal rear end face 23 of the barrel 2 in the longitudinal direction. A tubular support 522 extends from the conductive contact portion 524 and slidably into the rear end portion 22 of the barrel 2.

An insulator unit, in the form of an insulator layer 5120 on the inner wall surface of the tail cap member 51, prevents electrical connection between the conductive contact portion 524 and the barrel 2 via the tail cap member 51.

The conductive biasing member 53 has a first biasing end 531 adapted to contact electrically the second electrode 32 of the battery unit 3 and a second biasing end 532 disposed in the tubular support 522 and electrically connected to the conductive contact portion 524.

The annular contact blocking member 54, such as a C-shaped ring in this embodiment, is made of an insulator material, is disposed around the rear end portion 22 of the barrel 2 and within the contact receiving space 512, and abuts against the annular shoulder 514.

When the tubular support 522 is made of a conductive material and is formed integrally with the conductive contact portion, the tail cap switch 5 can further include an insulator sleeve 55 sleeved on the tubular support 522 and in sliding engagement with the rear end portion 22 of the barrel 2.

In practice, the tail cap member 51 is adjustable relative to the barrel 2 to one of a normally closed position, a normally open position, and a switch on/off position between the normally closed position and the normally open position.

Figure 3:
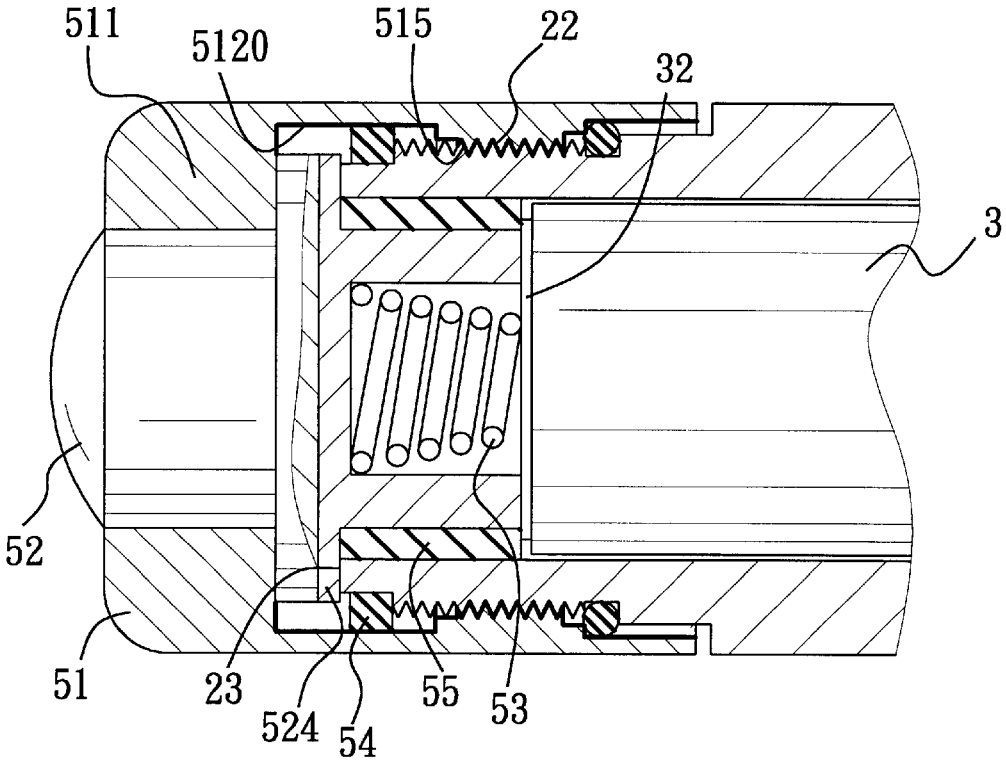
FIG. 3 is a fragmentary sectional view of the tail cap switch of the first preferred embodiment of the present invention when in a normally closed position.

Referring to FIG. 3, when the tail cap member 51 is at the normally closed position, the contact blocking member 54 does not project rearwardly relative to the distal rear end face 23 of the barrel 2, and the end wall 511 of the tail cap member 51 presses the conductive contact portion 524 of the push button member 52 to abut against the distal rear end face 23 of the barrel 2 and thus form a closed electrical circuit.

Figure 4:
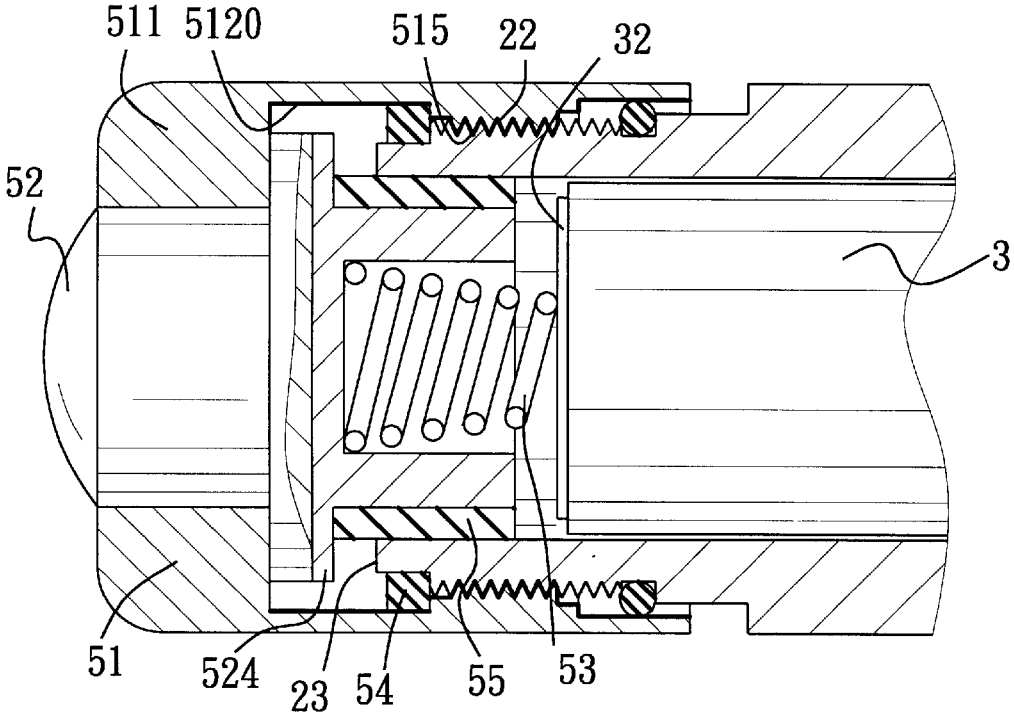
FIG. 4 is a fragmentary sectional view of the tail cap switch of the first preferred embodiment of the present invention when a push button member thereof is in a non-operated state and the tail cap switch is in a switch on-off position.

When the tail cap member 51 is at the switch on/off position, the contact blocking member 54 does not project rearwardly relative to the distal rear end face 23 of the barrel 2, and the conductive biasing member 53 biases the push button member 52 such that the conductive contact portion 524 abuts against the end wall 511 of the tail cap member 51 and is spaced apart from the distal rear end face 23 of the barrel 2 to break electrical connection between the conductive contact portion 524 and the barrel 2 in a non-operated state of the push button member 52, as shown in FIG. 4.

Figure 5:
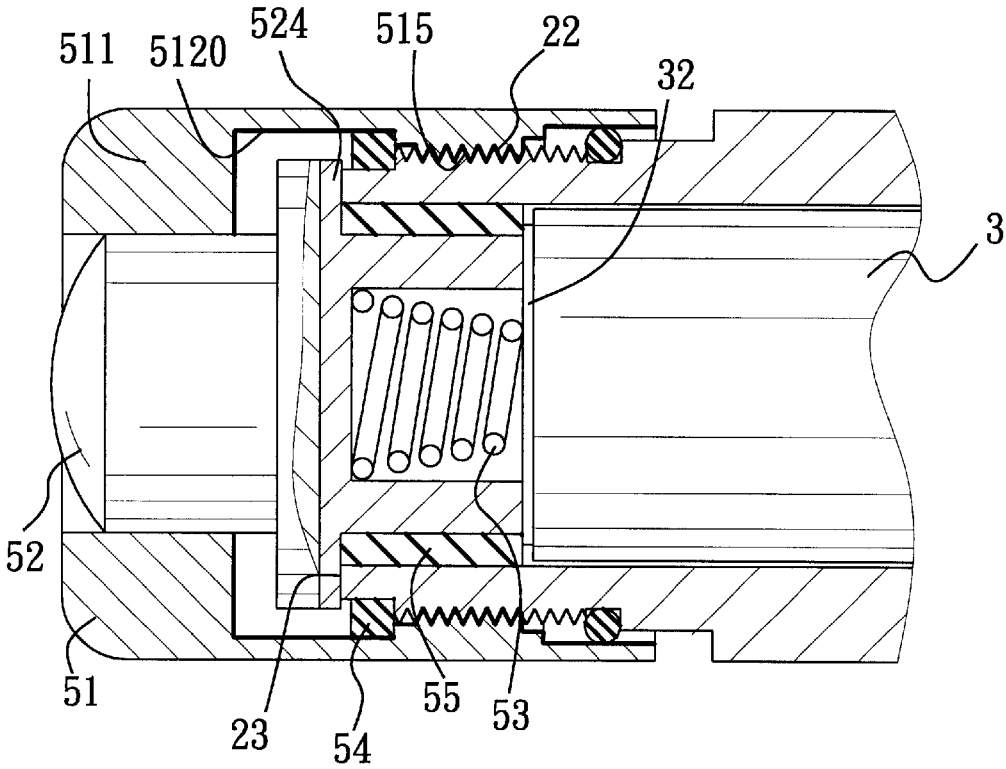
FIG. 5 is a fragmentary sectional view of the tail cap switch of the first preferred embodiment of the present invention when the push button member thereof is in an operated state and the tail cap switch is in the switch on-off position.

Referring to FIG. 5, the push button member 52 is movable in the longitudinal direction against biasing action of the biasing member 53 to abut the conductive contact portion 524 against the distal rear end face 23 of the barrel 2 and make electrical connection therebetween when an external pressing force is applied on the operating portion 521.

Figure 6:
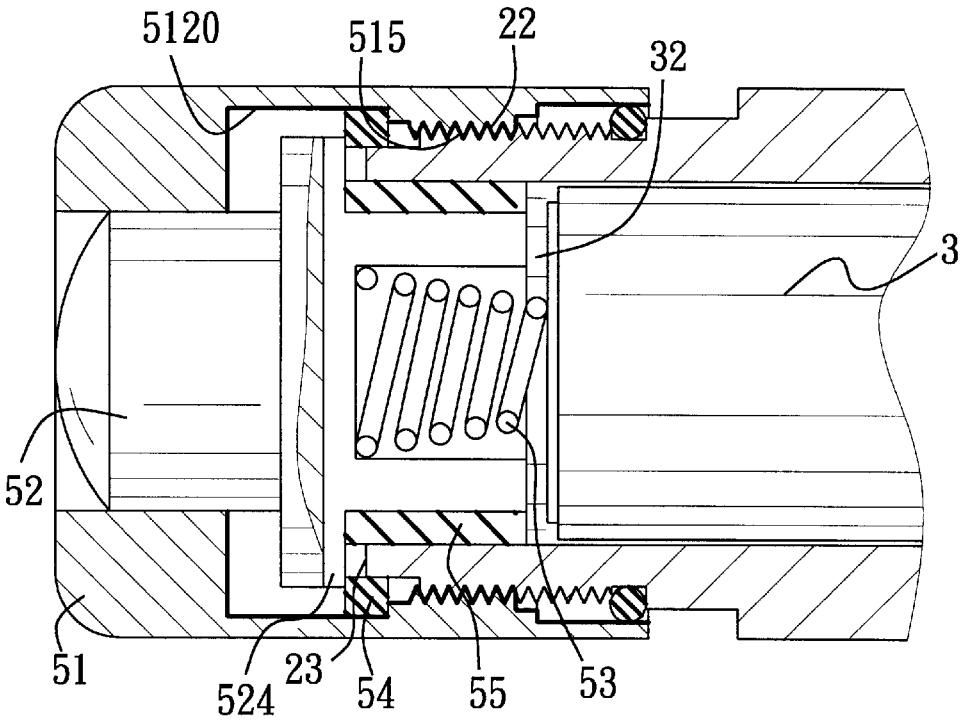
FIG. 6 is a fragmentary sectional view of the tail cap switch of the first preferred embodiment of the present invention when in a normally open position.

Referring to FIG. 6, when the tail cap member 51 is at the normally open position, the contact blocking member 54 is disposed to project rearwardly relative to the distal rear end face 23 of the barrel 2 so as to prevent the conductive contact portion 524 of the push button member 52 from abutting against the distal rear end face 23 of the barrel 2.

Figure 7:
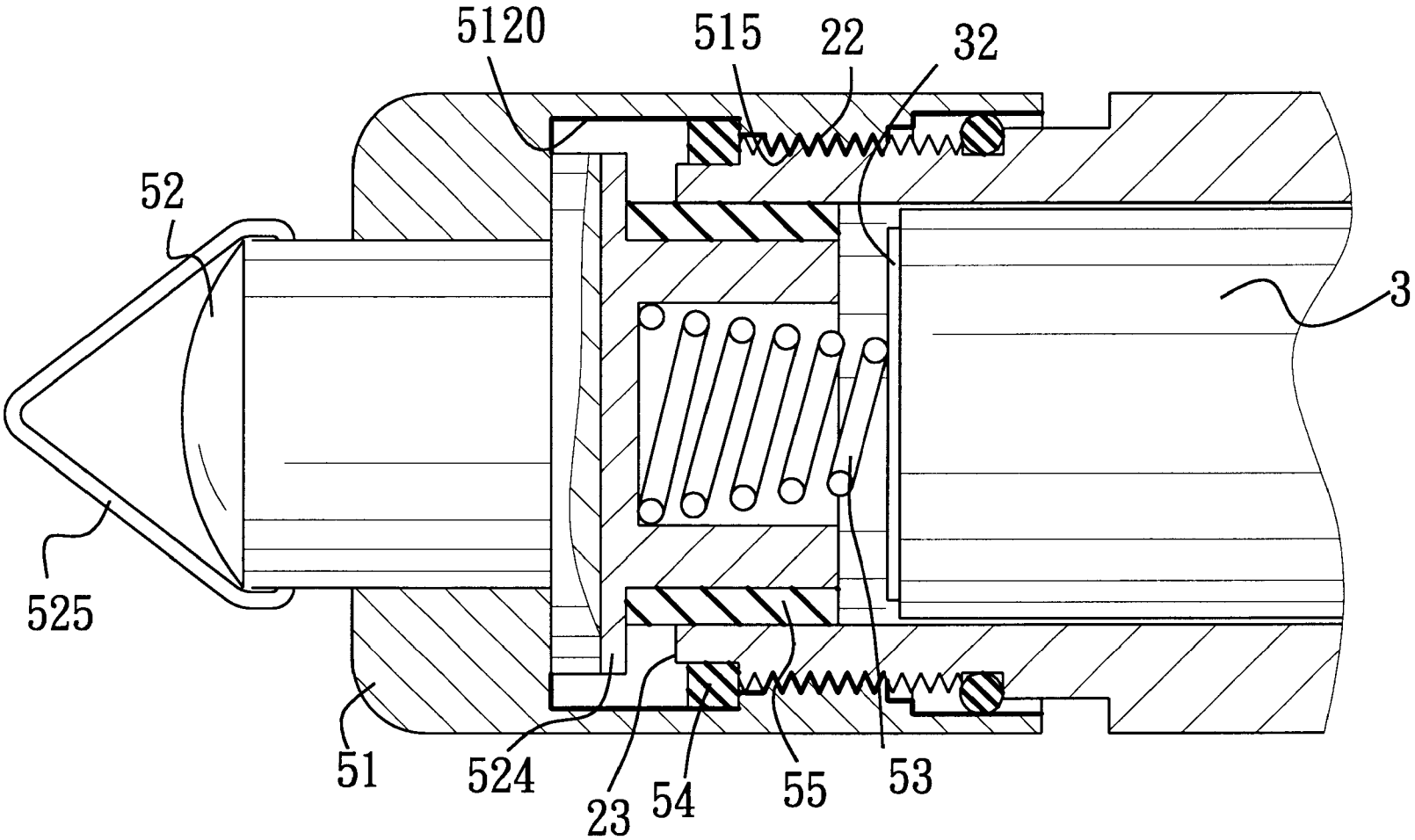
FIG. 7 is a fragmentary sectional view of a tail cap switch of a second preferred embodiment of a flashlight according to the present invention.

Referring to FIG. 7, in a second preferred embodiment of this invention, a key ring 525 can be mounted on the operating portion 521 of the push button member 52 and can prevent the conductive contact portion 524 from abutting undesirably against the distal rear end face 23 of the barrel 2.

In summary, the contact blocking member 54 can limit the push button member 52 to move only within the contact receiving space 512, thus preventing the push button member 52 and the conductive biasing member 53 from falling off when the tail cap switch 5 is removed from the barrel 2. In addition, because the push button member 52 can be adjusted to the normally open position, the drawback of waste of battery power due to accidental or unintentional pressing of the push button member 52 can be eliminated as well.

While the present invention has been described in connection with what is considered the most practical and preferred embodiments, it is understood that this invention is not limited to the disclosed embodiments but is intended to cover various arrangements included within the spirit land scope of the broadest interpretation so as to encompass all such modifications and equivalent arrangements.

I claim:

1. A flashlight comprising:

a conductive barrel adapted to receive a battery unit therein, said barrel extending in a longitudinal direction and having a front end portion and an externally threaded rear end portion with a distal rear end face, the battery unit having a first electrode and a second electrode opposite to the first electrode in the longitudinal direction;

a lamp unit mounted in said front end portion, said lamp unit including a lamp having a first lamp terminal connected electrically to said barrel and a second lamp terminal adapted to be connected electrically to the first electrode; and a tail cap switch mounted on said rear end portion of said barrel, said tail cap switch including a tail cap member having an end wall and a tubular wall extending from a periphery of said end wall in the longitudinal direction, said end wall being formed with a button hole, said tubular wall having an inner wall surface formed with an internally threaded segment that is spaced apart from said end wall in the longitudinal direction and that cooperates with said end wall to form a contact receiving space, said internally threaded segment threadedly engaging said rear end portion of said barrel and forming an annular shoulder at a boundary with said contact receiving space, a push button member having an operating portion slidably extending through said button hole, a conductive contact portion connected to said operating portion and extending into said contact receiving space, said conductive contact portion being disposed to confront said distal rear end face of said barrel in the longitudinal direction, and a tubular support extending from said conductive contact portion and slidably into said rear end portion of said barrel, an insulator unit for preventing electrical connection between said conductive contact portion and said barrel via said tail cap member, a conductive biasing member having a first biasing end adapted to contact electrically the second electrode of the battery unit, and a second biasing end disposed in said tubular support and electrically connected to said conductive contact portion, and an annular contact blocking member made of an insulator material, disposed around said rear end portion of said barrel and within said contact receiving space, and abutting against said annular shoulder;

said tail cap member being adjustable relative to said barrel to one of a normally closed position, a normally open position, and a switch on/off position between said normally closed position and said normally open position;

wherein, when said tail cap member is at the normally closed position, said contact blocking member does not project rearwardly relative to said distal rear end face of said barrel, and said end wall of said tail cap member presses said conductive contact portion of said push button member to abut against said distal rear end face of said barrel and thus form a closed electrical circuit;

wherein, when said tail cap member is at the switch on/off position, said contact blocking member does not project rearwardly relative to said distal rear end face of said barrel, and said biasing member biases said push button member such that said conductive contact portion abuts against said end wall of said tail cap member and is spaced apart from said distal rear end face of said barrel to break electrical connection between said conductive contact portion and said barrel in a non-operated state of said push button member, said push button member being movable in the longitudinal direction against biasing action of said biasing member to abut said conductive contact portion against said distal rear end face of said barrel and make electrical connection therebetween when an external pressing force is applied on said operating portion;

wherein, when said tail cap member is at the normally open position, said contact blocking member is disposed to project rearwardly relative to said distal rear end face of said barrel so as to prevent said conductive contact portion of said push button member from abutting against said distal rear end face of said barrel.

2. The flashlight of claim 1, wherein said contact blocking member is a C-shaped ring.

3. The flashlight of claim 1, wherein said tubular support is made of a conductive material and is formed integrally with said conductive contact portion, said tail cap switch further including an insulator sleeve sleeved on said tubular support and in sliding engagement with said rear end portion of said barrel.

4. The flashlight of claim 1, further comprising a key ring mounted on said operating portion of said push button member.

* * * * *